US012324951B2

(12) United States Patent
Tsai et al.

(10) Patent No.: US 12,324,951 B2
(45) Date of Patent: Jun. 10, 2025

(54) TREADMILL

(71) Applicant: Yu-Lun Tsai, Taichung (TW)

(72) Inventors: Yu-Lun Tsai, Taichung (TW); Yang Li, Zhangzhou (CN)

(73) Assignee: Yu-Lun Tsai, Taichung (TW)

( * ) Notice: Subject to any disclaimer, the term of this patent is extended or adjusted under 35 U.S.C. 154(b) by 153 days.

(21) Appl. No.: 18/453,878

(22) Filed: Aug. 22, 2023

(65) Prior Publication Data

US 2025/0065184 A1 Feb. 27, 2025

(30) Foreign Application Priority Data

Aug. 25, 2022 (CN) ..... 202222249653.6

(51) Int. Cl.
*A63B 22/02* (2006.01)

(52) U.S. Cl.
CPC ..... *A63B 22/0221* (2015.10); *A63B 22/0235* (2013.01)

(58) Field of Classification Search
CPC ..... A63B 22/0221; A63B 22/0235; A63B 2209/00; A63B 71/0054; A63B 22/02; A63B 22/025; A63B 21/4035; A63B 24/0087; A63B 2225/74; A63B 2230/208; A63B 2230/505; A63B 21/005; A63B 21/008; A63B 21/0085; A63B 22/0023; A63B 24/0059; A63B 2024/009; A63B 2071/0072; A63B 2071/0081; A63B 2071/0658; A63B 2071/0694; A63B 2220/53; A63B 2220/805; A63B 2225/09; A63B 2225/093; A63B 2225/685; A63B 2230/062; A63B 69/0057; A63B 2071/0625; A63B 2071/063; A63B 2071/0647; A63B 2071/0655; A63B 2220/13; A63B 2220/18; A63B 2220/30; A63B 2220/40; A63B 2220/803; A63B 2230/75; A63B 2071/0063; A63B 2220/56; A63B 2225/682; A63B 2230/06; A63B 22/0285; A63B 71/0622; A63B 2024/0093; A63B 2071/0691; A63B 2220/22; A63B 2225/50; A63B 2230/04; A63B 2230/207; A63B 2230/42; A63B 2230/50

See application file for complete search history.

(56) References Cited

U.S. PATENT DOCUMENTS 5,336,144 A * 8/1994 Rodden ..... A63B 22/02 482/54
5,921,892 A * 7/1999 Easton ..... A63B 22/02 482/54

(Continued)

*Primary Examiner* — Garrett K Atkinson
(74) *Attorney, Agent, or Firm* — Chun-Ming Shih; LANWAY IPR SERVICES

(57) ABSTRACT

A treadmill includes a treadmill body including a main support unit and a belt mechanism. The main support unit includes at least one first frame, at least one second frame located under the at least one first frame, multiple first elastic shock-absorbing members mounted between the at least one first frame and the at least one second frame, and multiple second elastic shock-absorbing members mounted on a bottom of the at least one second frame. The at least one first frame and the at least one second frame are arranged and combined to construct a multi-layer frame structure. The belt mechanism is mounted on the at least one first frame.

6 Claims, 3 Drawing Sheets

(56) References Cited

U.S. PATENT DOCUMENTS

| | | | | |
|---|---|---|---|---|
| 6,013,011 | A * | 1/2000 | Moore | A63B 22/02 482/77 |
| 9,463,349 | B1 * | 10/2016 | Chang | A63B 22/02 |
| 10,478,666 | B2 * | 11/2019 | Yoo | A63B 22/0214 |
| 10,589,146 | B2 * | 3/2020 | Becker | A63B 22/0228 |
| 10,821,320 | B2 * | 11/2020 | Lo | A63B 22/0214 |
| 11,000,728 | B2 * | 5/2021 | Frank | A63B 22/025 |
| 2007/0298937 | A1 * | 12/2007 | Shah | A63B 22/02 482/54 |
| 2016/0279465 | A1 * | 9/2016 | Chang | A63B 22/02 |
| 2022/0062698 | A1 * | 3/2022 | Tsai | A63B 22/0285 |
| 2022/0314061 | A1 * | 10/2022 | Tsai | A63B 22/0285 |
| 2023/0020081 | A1 * | 1/2023 | Ellis | A63B 71/023 |

* cited by examiner

TREADMILL

BACKGROUND OF THE INVENTION

Field of the Invention

The present invention relates to an exercising machine and, more particularly, to a treadmill or a running exercise machine.

Description of the Related Art

A conventional treadmill comprises a support frame, a belt mechanism mounted on the support frame, an upright mounted on the support frame, and a console mounted on the upright. The support frame is a single-layer structure. A vibration damping structure is mounted on the support frame to reduce the vibration produced during running. However, the noise eliminating effect of the support frame with a single-layer structure is limited, so that the noise produced during running easily causes disturbance to the neighbor downstairs.

BRIEF SUMMARY OF THE INVENTION

In accordance with the present invention, there is provided a treadmill comprising a treadmill body. The treadmill body includes a main support unit and a belt mechanism. The main support unit includes at least one first frame, at least one second frame located under the at least one first frame, multiple first elastic shock-absorbing members mounted between the at least one first frame and the at least one second frame, and multiple second elastic shock-absorbing members mounted on a bottom of the at least one second frame. The at least one first frame and the at least one second frame are arranged and combined to construct a multi-layer frame structure. The first elastic shock-absorbing members are dispersed and arranged between the at least one first frame and the at least one second frame. The second elastic shock-absorbing members are dispersed and arranged on the bottom of the at least one second frame. The belt mechanism is mounted on the at least one first frame.

According to the primary advantages of the present invention, the at least one first frame and the at least one second frame cooperate with the first elastic shock-absorbing members and the second elastic shock-absorbing members to efficiently eliminate the vibration noise produced during running, and to prevent the noise from causing disturbance to the neighbor downstairs.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
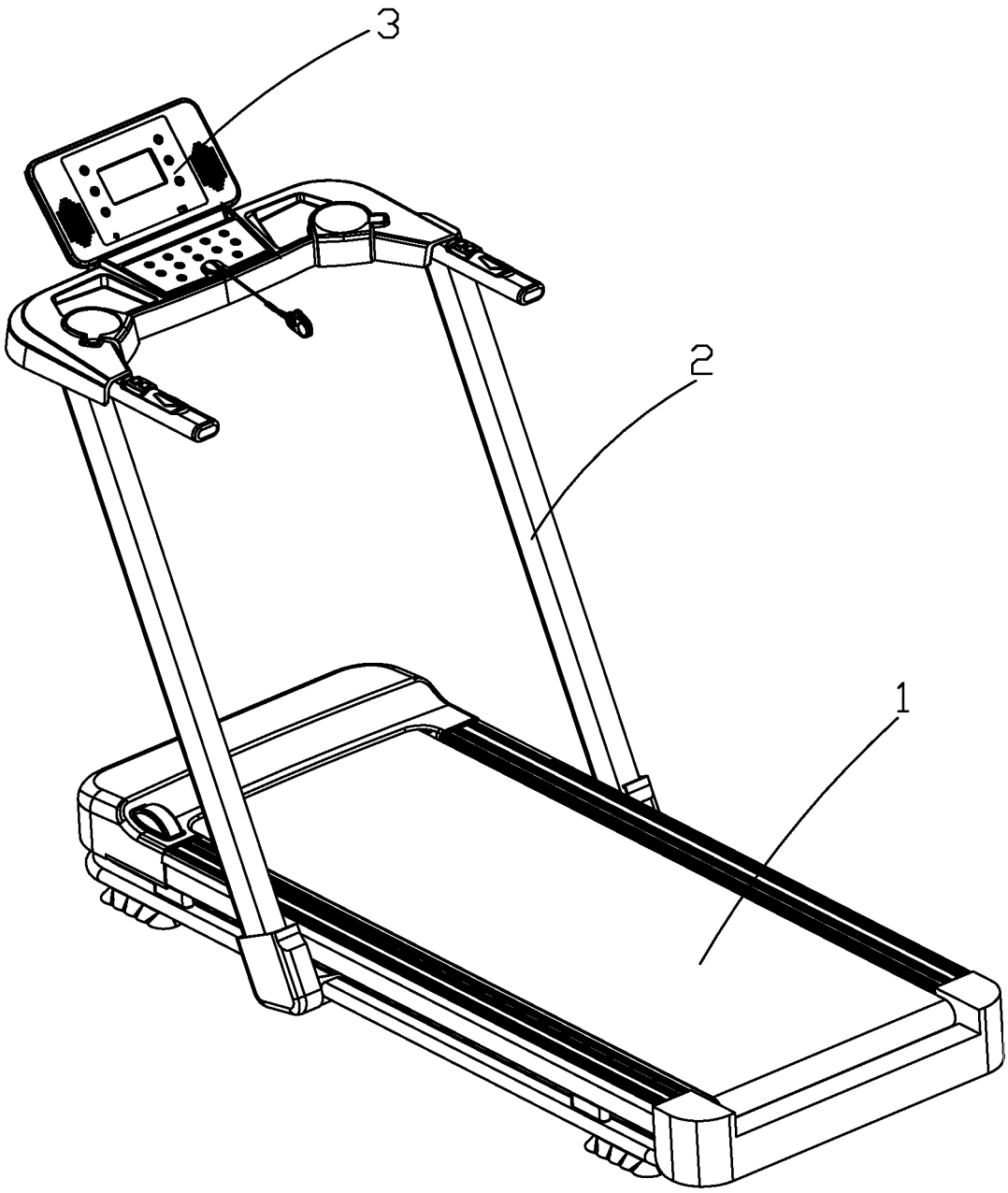
FIG. 1 is a perspective view of a treadmill in accordance with the preferred embodiment of the present invention.
Figure 2:
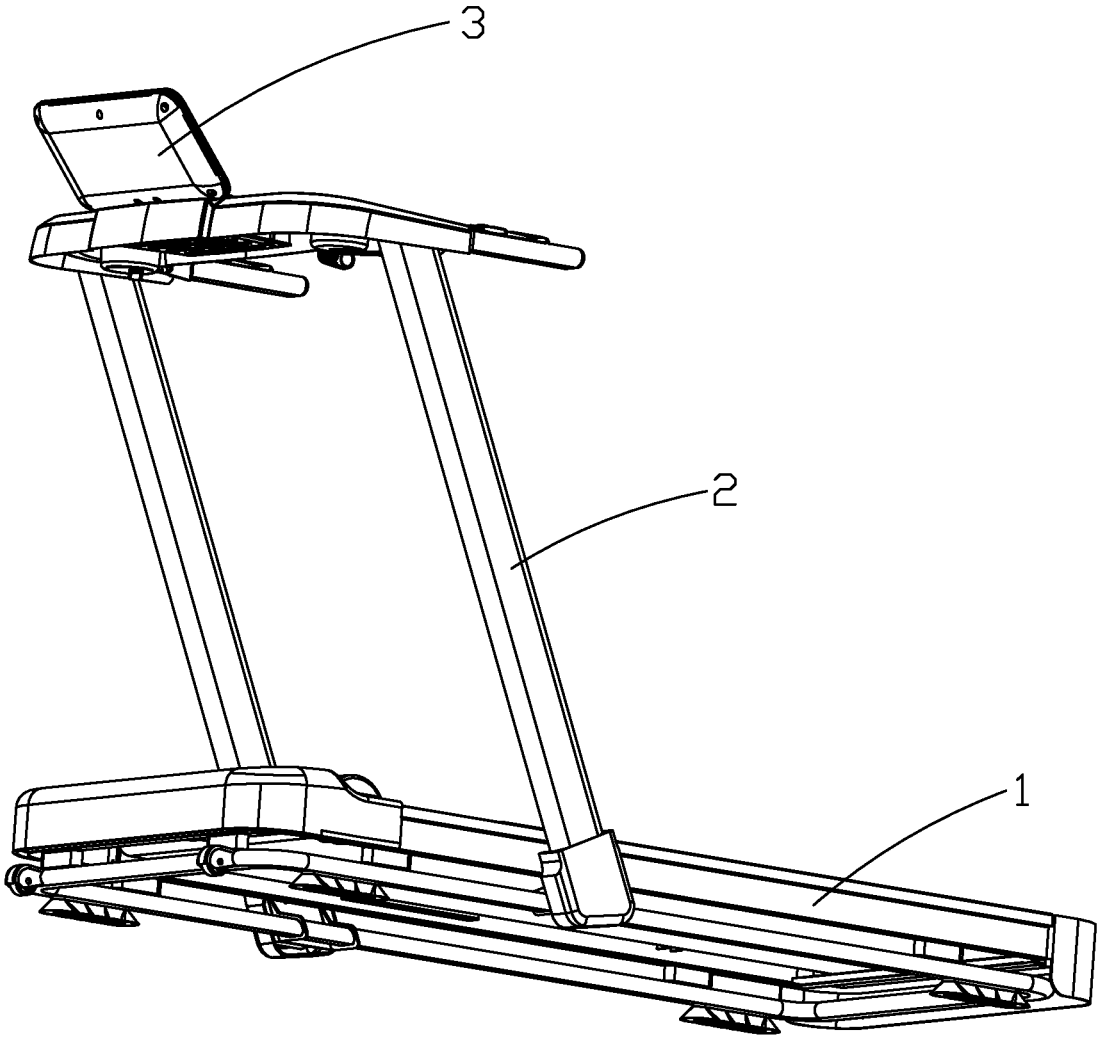
FIG. 2 is another perspective view of the treadmill in accordance with the preferred embodiment of the present invention.
Figure 3:
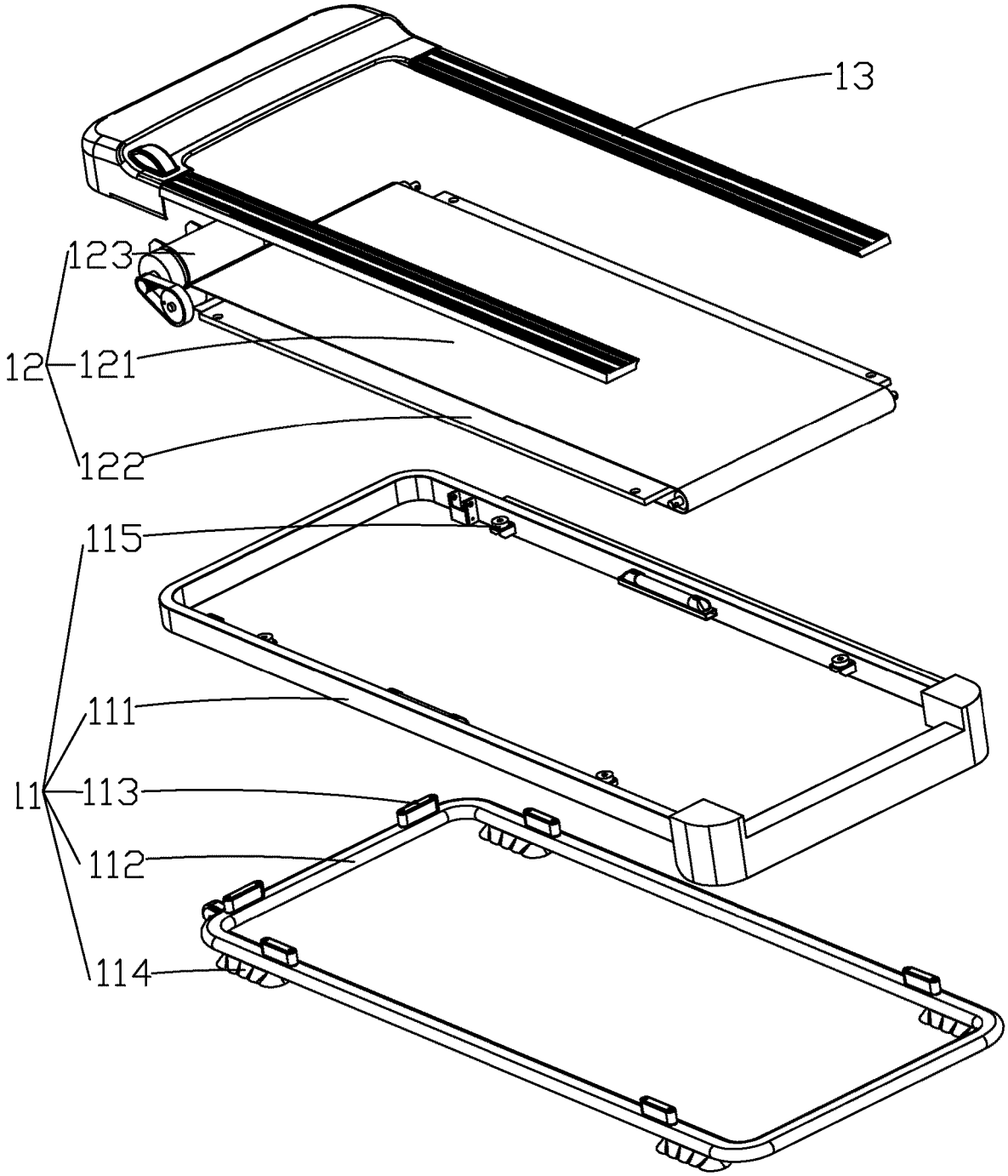
FIG. 3 is an exploded perspective view of the treadmill in accordance with the preferred embodiment of the present invention.

Referring to FIGS. 1-3, a treadmill in accordance with the preferred embodiment of the present invention comprises a treadmill body (or running platform) 1. The treadmill body 1 includes a main support unit 11 and a belt mechanism 12. The main support unit 11 includes at least one first frame 111, at least one second frame 112 located under the at least one first frame 111, multiple first elastic shock-absorbing members 113 mounted between the at least one first frame 111 and the at least one second frame 112 to provide shock-absorbing and vibration damping functions, and multiple second elastic shock-absorbing members 114 mounted on a bottom of the at least one second frame 112 to provide shock-absorbing and vibration damping functions. The at least one first frame 111 and the at least one second frame 112 are arranged and combined to construct a multi-layer frame structure. The first elastic shock-absorbing members 113 are dispersed and arranged between the at least one first frame 111 and the at least one second frame 112. The second elastic shock-absorbing members 114 are dispersed and arranged on the bottom of the at least one second frame 112. The belt mechanism 12 is mounted on the at least one first frame 111.

In practice, the first elastic shock-absorbing members 113 are mounted between the at least one first frame 111 and the at least one second frame 112 to provide shock-absorbing and vibration damping functions. The belt mechanism 12 is mounted on the at least one first frame 111. The second elastic shock-absorbing members 114 are dispersed and arranged on the bottom of the at least one second frame 112. Thus, when the user are running on the belt mechanism 12, the first elastic shock-absorbing members 113 provides shock-absorbing and vibration damping functions between the at least one first frame 111 and the at least one second frame 112, so that the vibration produced by the belt mechanism 12 will not be directly transmitted to the ground, thereby efficiently reducing noise produced during the running process, and thereby preventing the noise from causing disturbance to the neighbor downstairs. In addition, the second elastic shock-absorbing members 114 are located between the at least one second frame 112 and the ground to further provide shock-absorbing and vibration damping functions so as to eliminate the noise produced by vibration. In such a manner, the multi-layer frame structure of the at least one first frame 111 and the at least one second frame 112 cooperates with the first elastic shock-absorbing members 113 and the second elastic shock-absorbing members 114 to efficiently eliminate the vibration noise during running, and to prevent the noise from causing disturbance to the neighbor downstairs.

In the preferred embodiment of the present invention, the main support unit 11 includes a first frame 111 and a second frame 112 which construct a two-layer frame structure.

In the preferred embodiment of the present invention, each of the first elastic shock-absorbing members 113 is a rubber cushion (or pad), and each of the second elastic shock-absorbing members 114 is a rubber sucker base. Alternatively, each of the first elastic shock-absorbing members 113 is a spring structure.

In the preferred embodiment of the present invention, the first elastic shock-absorbing members 113 and the second elastic shock-absorbing members 114 are arranged at different height. In addition, the first elastic shock-absorbing members 113 and the second elastic shock-absorbing members 114 are alternated (or staggered) with each other. In such a manner, after the first elastic shock-absorbing members 113 reduce the vibration of the at least one first frame 111, the residual vibration will not be directly transmitted through the at least one second frame 112 and the second elastic shock-absorbing members 114 to the ground. Thus, the first elastic shock-absorbing members 113 and the second elastic shock-absorbing members 114 provide better vibration damping and noise eliminating functions.

In the preferred embodiment of the present invention, the belt mechanism 12 includes an endless running belt (or treadmill belt) 121, a support board 122 supporting an upper part of the running belt 121, and a drive motor module (or motor drive system) 123 driving and moving the running belt 121. The running belt 121 is movably connected with the at least one first frame 111 by two rollers. The drive motor module 123 is installed and secured on the at least one first frame 111. The drive motor module 123 has a drive end mechanically connected with one of the two rollers by a mechanic transmission connecting structure. The main support unit 11 further includes multiple third elastic shock-absorbing members 115 mounted on the at least one first frame 111 to provide shock-absorbing and vibration damping functions. The third elastic shock-absorbing members 115 are dispersed and arranged on the at least one first frame 111. The support board 122 is elastically supported on the third elastic shock-absorbing members 115. The support board 122 faces an inner face of the upper part of the running belt 121. Thus, the third elastic shock-absorbing members 115 further provides vibration damping and noise eliminating functions during running.

In the preferred embodiment of the present invention, each of the third elastic shock-absorbing members 115 is a rubber cushion (or pad). Alternatively, each of the third elastic shock-absorbing members 115 is a spring structure.

In the preferred embodiment of the present invention, the treadmill body 1 further includes two footboards (or footrests or treadles) 13 mounted on two sides of the at least one first frame 111.

In the preferred embodiment of the present invention, the treadmill further comprises an upright rack 2 having a lower end mounted on the at least one second frame 112, and a controller (or a console assembly) 3 mounted on the upright rack 2. The upright rack 2 is provided with a handlebar. The controller 3 is used to adjust an operation mode of the belt mechanism 12. The controller 3 includes contact switches or push buttons. In such a manner, the upright rack 2 is directly mounted on the at least one second frame 112, without contacting with the at least one first frame 111, so that the upright rack 2 is not affected by the vibration produced during running. Thus, the controller 3 on the upright rack 2 will not produce vibration or sway so that the user operates the controller 3 at a steady state.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A treadmill comprising:

a treadmill body;

wherein:

the treadmill body includes a main support unit and a belt mechanism;

the main support unit includes:

at least one first frame;

at least one second frame located under the at least one first frame;

multiple first elastic shock-absorbing members mounted between the at least one first frame and the at least one second frame; and multiple second elastic shock-absorbing members mounted on a bottom of the at least one second frame;

the at least one first frame and the at least one second frame are arranged and combined to construct a multi-layer frame structure;

the first elastic shock-absorbing members are dispersed and arranged between the at least one first frame and the at least one second frame;

the second elastic shock-absorbing members are dispersed and arranged on the bottom of the at least one second frame;

the belt mechanism is mounted on the at least one first frame;

the belt mechanism includes an endless running belt, a support board supporting an upper part of the running belt, and a drive motor module driving and moving the running belt;

the running belt is movably connected with the at least one first frame by two rollers;

the drive motor module is installed and secured on the at least one first frame;

the drive motor module has a drive end mechanically connected with one of the two rollers by a mechanic transmission connecting structure;

the main support unit further includes multiple third elastic shock-absorbing members mounted on the at least one first frame;

the third elastic shock-absorbing members are dispersed and arranged on the at least one first frame;

the support board is elastically supported on the third elastic shock-absorbing members; and the support board faces an inner face of the upper part of the running belt.

2. The treadmill as claimed in claim 1, wherein each of the first elastic shock-absorbing members is a rubber cushion, and each of the second elastic shock-absorbing members is a rubber sucker base.

3. The treadmill as claimed in claim 1, wherein:

the first elastic shock-absorbing members and the second elastic shock-absorbing members are arranged at different height; and the first elastic shock-absorbing members and the second elastic shock-absorbing members are alternated with each other.

4. The treadmill as claimed in claim 1, wherein each of the third elastic shock-absorbing members is a rubber cushion.

5. The treadmill as claimed in claim 1, wherein the treadmill body further includes two footboards mounted on two sides of the at least one first frame.

6. The treadmill as claimed in claim 1, further comprising:

an upright rack having a lower end mounted on the at least one second frame; and a controller mounted on the upright rack;

wherein:

the upright rack is provided with a handlebar;

the controller is used to adjust an operation mode of the belt mechanism; and the controller includes contact switches or push buttons.

* * * * *